US006293783B1

(12) United States Patent
Lee

(10) Patent No.: US 6,293,783 B1
(45) Date of Patent: Sep. 25, 2001

(54) LIGHTER WITH A THROUGH-HOLE AND REINFORCING RIBS

(76) Inventor: Jung-Hua Lee, No. 14, Lane 99, Tsyoing-Ta Road, Tsyoing Dist., Kaohsiung (TW)

( * ) Notice: Subject to any disclaimer, the term of this patent is extended or adjusted under 35 U.S.C. 154(b) by 0 days.

(21) Appl. No.: 09/598,294

(22) Filed: Jun. 21, 2000

(51) Int. Cl.[7] ..... F23Q 2/32

(52) U.S. Cl. ..... 431/253; 431/344; D27/143; D27/195; D3/208; 131/184.1

(58) Field of Search ..... 431/253, 344; D27/195, 142, 143; D3/208; 131/234, 256, 235.1, 184.1, 185

(56) References Cited

U.S. PATENT DOCUMENTS

| | | | | |
|---|---|---|---|---|
| 34,365 | * | 2/1862 | Willard | D27/125 |
| 346,453 | * | 8/1886 | Baldwin | 131/248 |
| D. 380,293 | * | 7/1997 | Cudmore | D3/208 |
| D. 387,474 | * | 12/1997 | Fontaine, Jr. | D27/142 |
| D. 392,409 | * | 3/1998 | Davidoski | D27/195 |
| 1,067,911 | * | 7/1913 | Freeman | 431/253 |
| 1,644,245 | * | 10/1927 | Freeman | 131/235.1 |
| 1,883,819 | * | 10/1932 | Pfingst | 131/235.1 |
| 1,928,041 | * | 9/1933 | Windesheim | 131/234 |
| 2,309,011 | * | 1/1943 | Porter | 131/234 |
| 2,572,863 | * | 10/1951 | Jasp | 431/253 |
| 2,606,562 | * | 8/1952 | Siegel | 131/235.1 |
| 3,092,119 | * | 6/1963 | Gold et al. . | |
| 4,131,120 | * | 12/1978 | Edgar | 131/238 |
| 4,478,230 | * | 10/1984 | Mazelie | 431/253 |
| 4,854,856 | * | 8/1989 | Steiger, Jr. et al. | 431/253 |
| 4,984,586 | * | 1/1991 | Nas-Won | 131/256 |
| 5,181,847 | * | 1/1993 | Da Silva | 431/253 |
| 5,682,981 | * | 11/1997 | Sudborough | 431/253 |

FOREIGN PATENT DOCUMENTS

| | | | | |
|---|---|---|---|---|
| 2360228 | * | 3/1978 | (FR) | 431/253 |

* cited by examiner

*Primary Examiner*—Carl D. Price
(74) *Attorney, Agent, or Firm*—Bacon & Thomas PLLC

(57) ABSTRACT

A lighter includes a housing having a through-hole defined by an annular wall. The annular wall has a thickness smaller than that of the remaining portion of the housing. A ring is attached to the through-hole for attaching keys. The annular wall has a central bulge portion, thereby having a maximum diameter in each of two outer portions of the through-hole and a minimum diameter in a central portion of the through-hole. The maximum diameter of the through-hole is greater than a diameter of a cigarette and the minimum diameter of the through-hole is smaller than the diameter of the cigarette.

7 Claims, 4 Drawing Sheets

LIGHTER WITH A THROUGH-HOLE AND REINFORCING RIBS

BACKGROUND OF THE INVENTION

1. Field of the Invention

The present invention relates to a lighter that is improved in strength includes a thinner wall portion to change the direction of explosion, if occurs. The present invention also relates to lighter that can increase the density of tobacco in the cigarette.

2. Description of the Related Art

Conventional lighters contain highly volatile fuel and thus might explode when they are placed in a vehicle and exposed to the sun. This may cause damage to the vehicle and injury to people in or adjacent to the vehicle. A further drawback to conventional lighters is that they cannot be attached to a key ring or the like. Smokers often place a filter cigarette upside-down and tap the filter end of the filter cigarette on a desk surface to make the tobacco become denser, yet the filtering effect is not improved, as the density in the filter portion is not changed.

SUMMARY OF THE INVENTION

It is the primary object of the present invention to provide a lighter that is improved in strength or has a thinner wall portion to change location of explosion, if occurs, thereby reducing possibility of injury to people.

It is another object of the present invention to provide a lighter that includes a through-hole in the lighter housing, thereby allowing the lighter to be attached to a key ring for convenient carriage.

It is a further object of the present invention to provide a lighter that includes at least one through-hole in the lighter housing through which a cigarette is passable for making the tobacco and the filter portion of the cigarette become denser.

A lighter in accordance with the present invention includes a lighter housing having at least one through-hole with a maximum diameter greater than a diameter of a cigarette and a minimum diameter smaller than the diameter of the cigarette. Thus, the cigarette may be passed through the through-hole to make the tobacco and the filter portion denser. The lighter housing may include reinforcing ribs to improve the strength. In addition, the lighter housing may include thinner wall portions to divert the force of explosion, if it occurs such that fragments and gas shall not scatter outward, thereby reducing possibility of injury to people.

Other objects, specific advantages, and novel features of the invention will become more apparent from the following detailed description and preferable embodiments when taken in conjunction with the accompanying drawings.

DETAILED DESCRIPTION OF THE PREFERRED EMBODIMENTS

Preferred embodiments in accordance with the present invention will now be described with reference to the accompanying drawings.

Figure 1:
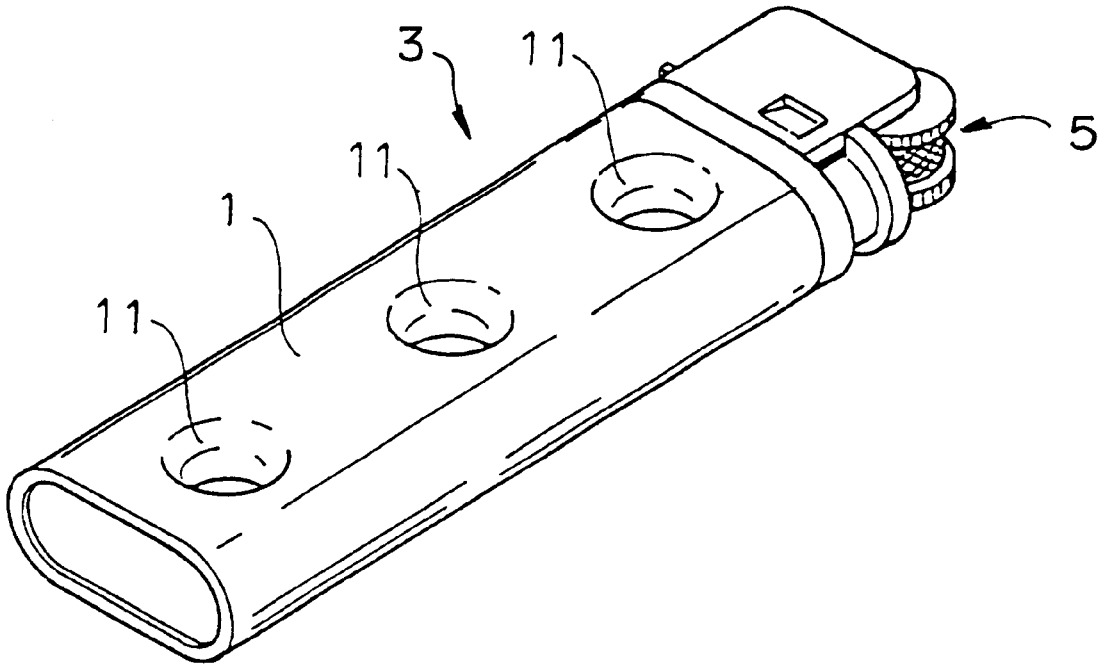
FIG. 1 is a perspective view of a lighter in accordance with the present invention.
Figure 2:
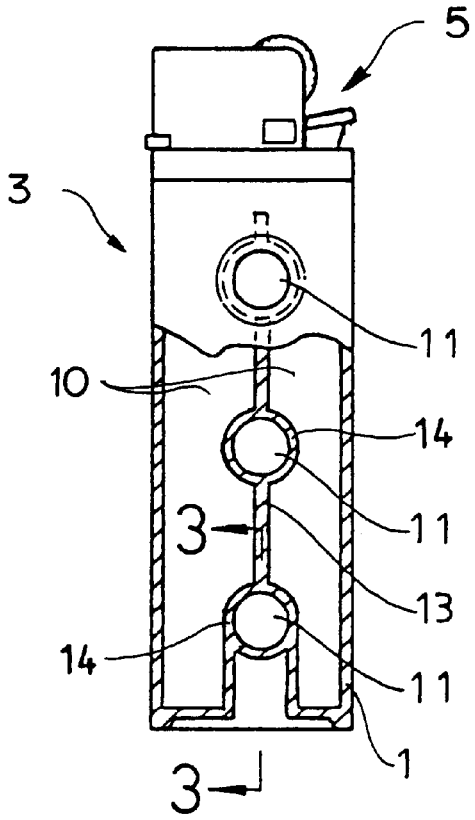
FIG. 2 is a side view, partly sectioned, of the lighter in accordance with the present invention.
Figure 3:
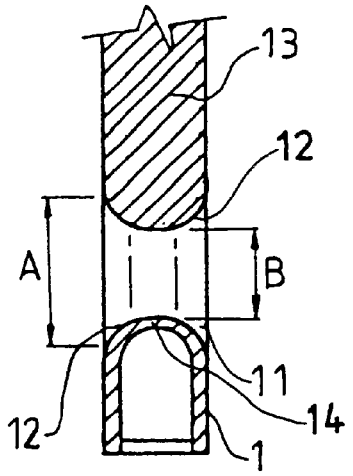
FIG. 3 is a sectional view taken along line 3—3 in FIG. 2.

Referring to FIG. 1, a lighter 3 in accordance with the present invention generally includes a housing 1 having at least one through-hole 11 and an igniter element 5. As illustrated in FIGS. 2 and 3, the through-hole 11 is defined by an annular wall 14 having a central bulge portion 12, thereby defining a maximum diameter A in each of two outer portions of the through-hole 11 and a minimum diameter B in a central portion of the through-hole 11. In addition, reinforcing ribs 13 are provided to connect the annular walls 14 defining the through-holes 11 for improving the strength overall of the lighter 3. Further, the annular wall 14 defining each through-hole 11 is the thinnest portion of the lighter housing and thus the weakest portion that when the lighter explodes due to high temperature or malfunction of the lighter, the fragments and the gas eject toward the center of the through-hole 11 and then rebound after they impact the opposite wall portion of the annular wall 14. As a result, the speed of the fragments and the gas caused by such explosion is greatly reduced as they collide with each other thereby reducing the injury to human body.

Referring to FIG. 2, the housing 1 includes at least two compartments 10, and each of the compartments 10 is provided between two sides (left and right) of the housing. The through-holes 11 are formed between the compartments 10 and extend through the front and rear sides of the housing 1, as shown in FIG. 2.

Figure 4:
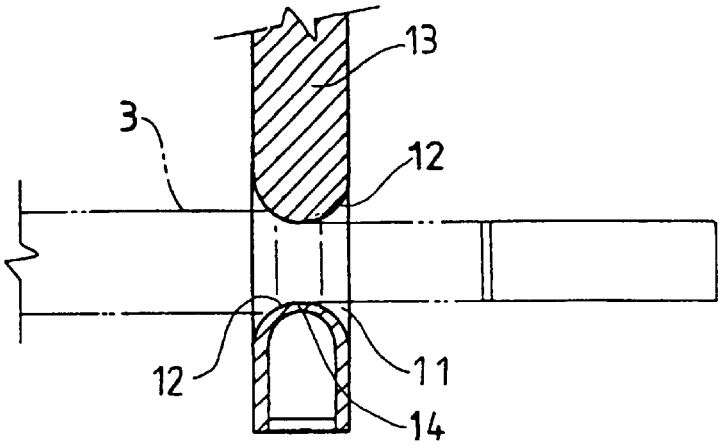
FIG. 4 is a sectional view similar to FIG. 3, illustrating an additional function of the lighter.
Figure 5:
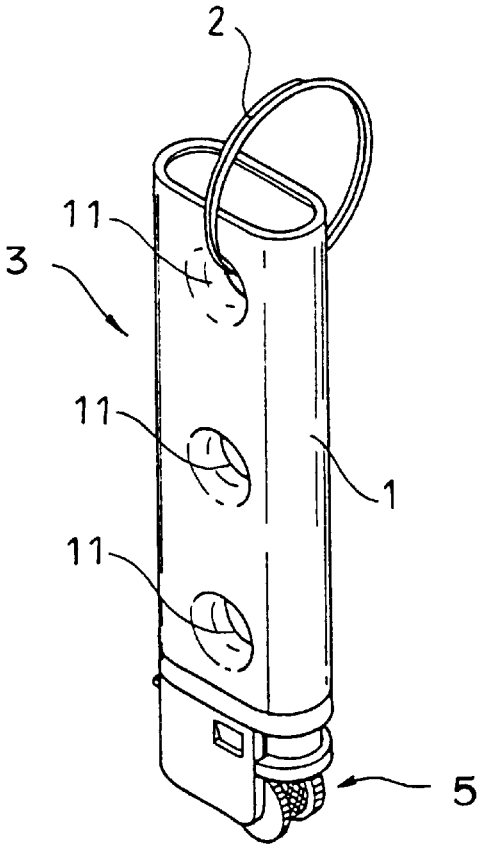
FIG. 5 is a perspective view illustrating attachment of the lighter to a key ring.
Figure 6:
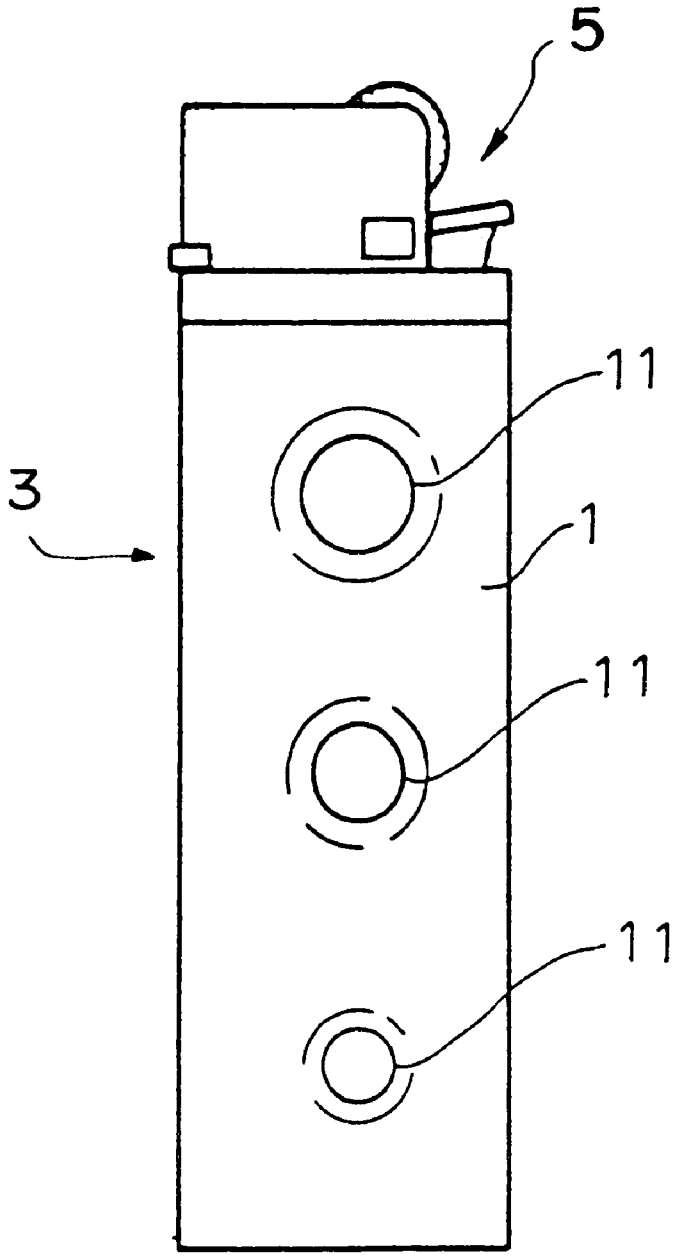
FIG. 6 is a schematic side view illustrating a modified embodiment of the lighter in accordance with the present invention.

Referring to FIG. 4, the smoker may pass a filtered cigarette 3 through the through-hole 11. Insertion of the filtered cigarette into the through-hole is easy, since the maximum diameter A of the through-hole 11 is greater than the diameter of the filtered cigarette 3. The tobacco and the filter portion of the filtered cigarettes becomes denser after the filter cigarette has passed through the through-hole 11, as the minimum diameter B of the through-hole 11 is smaller than the diameter of the filter cigarette. Thus, the filtering effect provided by the filter portion is increased. It was found that the nicotine is reduced by about 5% and the tar is reduced by about 14%. As illustrated in FIG. 6, when more than one through-hole 11 is provided, the through-holes may have different dimensions to suit cigarettes of various diameters. As illustrated in FIG. 5, the lighter can be attached to a key ring 2, thereby allowing convenient carriage.

According to the above description, it is appreciated that the reinforcing ribs 13 improve the strength of the lighter housing 1. The through-holes 11 form the weakest portions of the lighter housing 1 to provide weak locations such that if the lighter explodes, the impact of the explosion is directed away from human body. In addition, the through-holes 11 can be used to increase the density of the tobacco and the filter portion of a cigarette 3, thereby reducing the nicotine and tar inhaled into the human body. In addition, the through-holes 11 permit the lighter to be attached with a key ring, for convenient carriage.

Although the invention has been explained in relation to its preferred embodiment as mentioned above, it is to be understood that many other possible modifications and variations can be made without departing from the scope of the invention. It is, therefore, contemplated that the appended claims will cover such modifications and variations that fall within the true scope of the invention.

What is claimed is:

1. A lighter comprising:

a housing comprising a compartment, the compartment provided between at least two sides of the housing;

an igniter element attached to the housing;

at least one through-hole formed at the compartment and extending through at least two sides of the housing;

an annular wall provided around each of the at least one through-hole, the annular wall connected to the housing and being configured to increase the structural strength and rigidity of the housing; and the annular wall has a thickness smaller than that of any other portion of the housing such that in the event that the lighter explodes, explosive debris is directed toward the at least one through-hole, away from the user of the lighter.

2. The lighter as claimed in claim 1, further comprising a ring attached to the through-hole for attaching keys thereto.

3. The lighter as claimed in claim 1, wherein the annular wall has a central bulge portion, having a maximum diameter in each of two outer portions of the through-hole and a minimum diameter in a central portion of the through-hole.

4. The lighter as claimed in claim 3, wherein the maximum diameter of the through-hole is greater than a diameter of a cigarette and the minimum diameter of the through-hole is smaller than the diameter of the cigarette whereby when the cigarette is passed through the through-hole, its density is increased.

5. The lighter as claimed in claim 1, wherein the annular wall is provided with a weakened portion around the through-hole such that in the event that the lighter explodes, explosive debris is directed toward the at least one through-hole, away from a user of the lighter.

6. A lighter comprising:

a housing comprising a plurality of compartments, each of the compartments provided between at least two sides of the housing;

an igniter element attached to the housing;

a plurality of through-holes formed between the compartments and extending through at least two other sides of the housing;

a plurality of annular walls, a one of the annular walls provided around each of the through-holes, the annular walls connected to each other and to the housing and configured to increase the structural strength and rigidity of the housing; and at least one reinforcing rib for connecting the annular walls of the through-holes.

7. The lighter as claimed in claim 6, wherein the through-holes have different diameters.

* * * * *